US006169539B1

(12) United States Patent
Lee et al.

(10) Patent No.: US 6,169,539 B1
(45) Date of Patent: Jan. 2, 2001

(54) ANALOG VIDEO SIGNAL SELECTION CIRCUIT

(75) Inventors: Jin Sun Lee, Seoul; Myung Ho Kim, Ich'on, both of (KR)

(73) Assignee: Hyundai Electronics Industries Co., Ltd., Kyoungki-do (KR)

( * ) Notice: Under 35 U.S.C. 154(b), the term of this patent shall be extended for 0 days.

(21) Appl. No.: 09/105,740

(22) Filed: Jun. 26, 1998

(30) Foreign Application Priority Data

Jun. 30, 1997 (KR) ..... 97-30424

(51) Int. Cl.[7] ..... G09G 5/00

(52) U.S. Cl. ..... 345/204; 345/205; 345/211; 345/213

(58) Field of Search ..... 345/204, 205, 345/211, 212, 213

(56) References Cited

U.S. PATENT DOCUMENTS 4,167,704 * 9/1979 Sato et al. ..... 325/457
4,964,065 * 10/1990 Hicks et al. ..... 364/514
5,908,700 3/1990 Ishii et al. ..... 358/22
5,990,858 * 11/1999 Ozolins ..... 345/99
6,057,822 * 5/2000 Tsubota ..... 345/98

* cited by examiner

*Primary Examiner*—Richard A. Hjerpe
*Assistant Examiner*—Kimnhung Nguyen
(74) *Attorney, Agent, or Firm*—Selitto & Associates, P.C.

(57) ABSTRACT

An analog video signal selection circuit which selects one of video signals and synchronous signals from two different channels, including: a mode selection means for generating a first channel selection signal or a second channel selection signal in a manual mode or generating an automode selection signal in a auto mode; a data selection means for selecting one of the first data of R1, G1 and B1 received from the first channel or the second data R2, G2 and B2 received from the second channel and providing the selected data as R, G and B output signals in accordance with the first and second channel selection signals generated from the mode selection means; and a synchronous signal selection means for selecting one of a first synchronous data of horizontal and vertical synchronous signals from the first channel and a second synchronous data of horizontal and vertical synchronous signals from the second channel in accordance with the first and second channel selection signals generated from the mode selection means.

15 Claims, 5 Drawing Sheets

ANALOG VIDEO SIGNAL SELECTION CIRCUIT

BACKGROUND OF THE INVENTION

This invention relates to an analog video signal selection circuit for liquid crystal displays (LCDs), and more particularly to an analog video signal selection circuit for selecting one of video signals from two different channels.

A selection circuit for selecting one of video signals received from different channels for LCDs has been not disclosed. The video signal selection circuit has been demanded in LCDs applied to car navigation systems.

SUMMARY OF THE INVENTION

An object of the present invention is to provide an analog video signal selection circuit for automatically or manually selecting one of video signals from two different channels.

According an aspect of the present invention, there is provided to an analog video signal selection circuit for a liquid crystal display which selects one of first data of R1, G1 and B1 received from a first channel or second data of R2, G2 and B2 received from a second channel, comprising: a mode selection means for generating a first channel selection signal and a second channel selection signal in a manual mode and generating an automode selection signal in a auto mode; a data selection means for selecting one of the first data of R1, G1 and B1 received from the first channel or the second data R2, G2 and B2 received from the second channel and providing the selected data as R, G and B output signals in accordance with the first and second channel selection signals and the automode selection signal generated from the mode selection means; and a synchronous signal selection means for selecting one of a first synchronous data of horizontal and vertical synchronous signals from the first channe and a second synchronous data of horizontal and vertical synchronous signals from the second channel in accordance with the first and second channel selection signals and the automode selection signal generated from the mode selection means.

The mode selection means comprises a switch where a common terminal is connected to ground and movable terminals for generating the selection signals are connected the data selection means and the synchronous signal selection means.

The analog video signal selection circuit further comprising a priority channel selection means which detects a signal received from the priority channel of two channel and generates a first signal for selecting a priority channel to the data selection means and the synchronous signal selection means when the signal is received from the priority channel, or a second signal for selecting another channel of two channels to the data selection means and the synchronous signal selection means when the signal is not received from the priority channel, according to the automode selection signal. The priority channel selection means preferentially selects the first channel of two channels and generates the priority channel selection signal for selecting the first channel, when the horizontal synchronous signal is received from the first channel.

The priority channel selection means includes: a first signal generation means generates the first detection signal for selecting the priority channel of two channels, when the horizontal synchronous signal is received from the first channel in automode selection; a second signal generation means generates the second detection signal for selecting another channel of two channels, when the horizontal synchronous signal is not received from the first channel in automode selection; a detecting means for detecting the horizontal synchronous signal received from the first channel to drive one of the first signal generation means and the second signal generation means; and an enable means for enabling the first and second signal generation means in accordance with the automode selection signal received from the mode selection means.

The data selection means includes: a R data selection means for selecting one of the R1 data from the first channel or the R2 data from the second channel; a G data selection means for selecting one of the G1 data from the first channel or the G2 data from the second channel; a B data selection means for selecting one of the B1 data from the first channel or the B2 data from the second channel; and an output disable means for blocking the output of one of the first data of the first channel or the second data of the second channel in accordance with the first and second channel selection signals received from the mode selection means.

Each of the R, G, B data selection means includes: a first input means for receiving the first data from the first channel; a first output means for providing the first data received from the first input means as the R, G, or B output signal; a second input means for receiving the second data from the second channel; and a second output means for providing the second data from the second input means. The output disable means includes: a first disable means for simultaneously disabling all the first output means of the R, G and D data selection means in accordance with the first channel selection signal received from the mode selection means; and a second disable means for simultaneously disabling all second output means of the R, G and D data selection means in accordance with the second channel selection signal received from the mode selection means.

The synchronous signal selection means includes: a first selection means for selecting the synchronous signals of the first channel according to the first channel selection signal received from the mode selection means; and a second selection means for selecting the synchronous signals of the second channel according to the second channel selection signal received from the mode selection means.

The first selection includes: an output means for outputting the horizontal synchronous signal and the vertical synchronous signal from the first channel as the output synchronous signals; and a control means for controlling the output means by the first channel selection signal received from the mode selection means.

The second selection includes: a first input means for receiving the horizontal synchronous signal from the second channel; a second input means for receiving the vertical synchronous signal from the second channel; an output means for outputting the horizontal synchronous signal and the vertical synchronous signal of the second channel received from the first and second input means as the output synchronous signals; and a controlling means for controlling the output means by the second channel selection signal received from the mode selection means.

There is also provided to an analog video signal selection circuit for a liquid crystal display which selects one of first data of R1, G1 and B1 received from a first channel or second data of R2, G2 and B2 received from a second channel, comprising: a mode selection means for generating a first channel selection signal and a second channel selection signal in a manual mode and generating an automode selection signal in a auto mode; a data selection means for selecting one of the first data of R1, G1 and B1 received from the first channel or the second data R2, G2 and B2 received from the second channel and providing the selected data as R, G and B output signals in accordance with the first and second channel selection signals and the automode selection signal generated from the mode selection means; a synchronous signal selection means for selecting one of a first synchronous data of horizontal and vertical synchronous signals from the first channel and a second synchronous data of horizontal and vertical synchronous signals from the second channel in accordance with the first and second channel selection signals and the automode selection signal generated from the mode selection means; and a priority channel selection means which detects a signal received from the priority channel of two channel and generates a first signal for selecting a priority channel to the data selection means and the synchronous signal selection means when the signal is received from the priority channel, or a second signal for selecting another channel of two channels to the data selection means and the synchronous signal selection means when the signal is not received from the priority channel, according to the automode selection signal.

There is provided to an analog video signal selection circuit for a liquid crystal display which selects one of first data of R1, G1 and B1 received from a first channel or second data of R2, G2 and B2 received from a second channel, comprising: a mode selection means for generating a first channel selection signal and a second channel selection signal in a manual mode and generating an automode selection signal in a auto mode; a data selection means for selecting one of the first data of R1, G1 and B1 received from the first channel or the second data R2, G2 and B2 received from the second channel and providing the selected data as R, G and B output signals in accordance with the first and second channel selection signals and the automode selection signal generated from the mode selection means, the data selection means including a R data selection means for selecting one of the R1 data from the first channel or the R2 data from the second channel; a G data selection means for selecting one of the G1 data from the first channel or the G2 data from the second channel; a B data selection means for selecting one of the B1 data from the first channel or the B2 data from the second channel; and an output disable means for blocking the output of one of the first data of the first channel or the second data of the second channel in accordance with the first and second channel selection signals received from the mode selection means; and a synchronous signal selection means for selecting one of a first synchronous data of horizontal and vertical synchronous signals from the first channel and a second synchronous data of horizontal and vertical synchronous signals from the second channel in accordance with the first and second channel selection signals and the automode selection signal generated from the mode selection means, the synchronous signal selection means including a first selection means for selecting the synchronous signals of the first channel according to the first channel selection signal received from the mode selection means; and a second selection means for selecting the synchronous signals of the second channel according to the second channel selection signal received from the mode selection means.

There is provided to an analog video signal selection circuit for a liquid crystal display which selects one of first data of R1, G1 and B1 received from a first channel or second data of R2, G2 and B2 received from a second channel, comprising: a mode selection means for generating a first channel selection signal and a second channel selection signal in a manual mode and generating an automode selection signal in a auto mode; a data selection means for selecting one of the first data of R1, G1 and B1 received from the first channel or the second data R2, G2 and B2 received from the second channel and providing the selected data as R, G and B output signals in accordance with the first and second channel selection signals and the automode selection signal generated from the mode selection means, the data selection means including a R data selection means for selecting one of the R1 data from the first channel or the R2 data from the second channel; a G data selection means for selecting one of the G1 data from the first channel or the G2 data from the second channel; a B data selection means for selecting one of the B1 data from the first channel or the B2 data from the second channel; and an output disable means for blocking the output of one of the first data of the first channel or the second data of the second channel in accordance with the first and second channel selection signals received from the mode selection means; a synchronous signal selection means for selecting one of a first synchronous data of horizontal and vertical synchronous signals from the first channel and a second synchronous data of horizontal and vertical synchronous signals from the second channel in accordance with the first and second channel selection signals and the automode selection signal generated from the mode selection means, the synchronous signal selection means including a first selection means for selecting the synchronous signals of the first channel according to the first channel selection signal received from the mode selection means; and a second selection means for selecting the synchronous signals of the second channel according to the second channel selection signal received from the mode selection means; and a priority channel selection means which detects a signal received from the priority channel of two channel and generates a first signal for selecting a priority channel to the data selection means and the synchronous signal selection means when the signal is received from the priority channel, or a second signal for selecting another channel of two channels to the data selection means and the synchronous signal selection means when the signal is not received from the priority channel, according to the automode selection signal, the priority channel selection means including a first signal generation means generates the first detection signal for selecting the priority channel of two channels, when the horizontal synchronous signal is received from the first channel in automode selection; a second signal generation means generates the second detection signal for selecting another channel of two channels, when the horizontal synchronous signal is not received from the first channel in automode selection; a detecting means for detecting the horizontal synchronous signal received from the first channel to drive one of the first signal generation means and the second signal generation means; and an enable means for enabling the first and second signal generation means in accordance with the automode selection signal received from the mode selection means.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DETAILED DESCRIPTION OF THE PREFERRED EMBODIMENT

Figure 1:
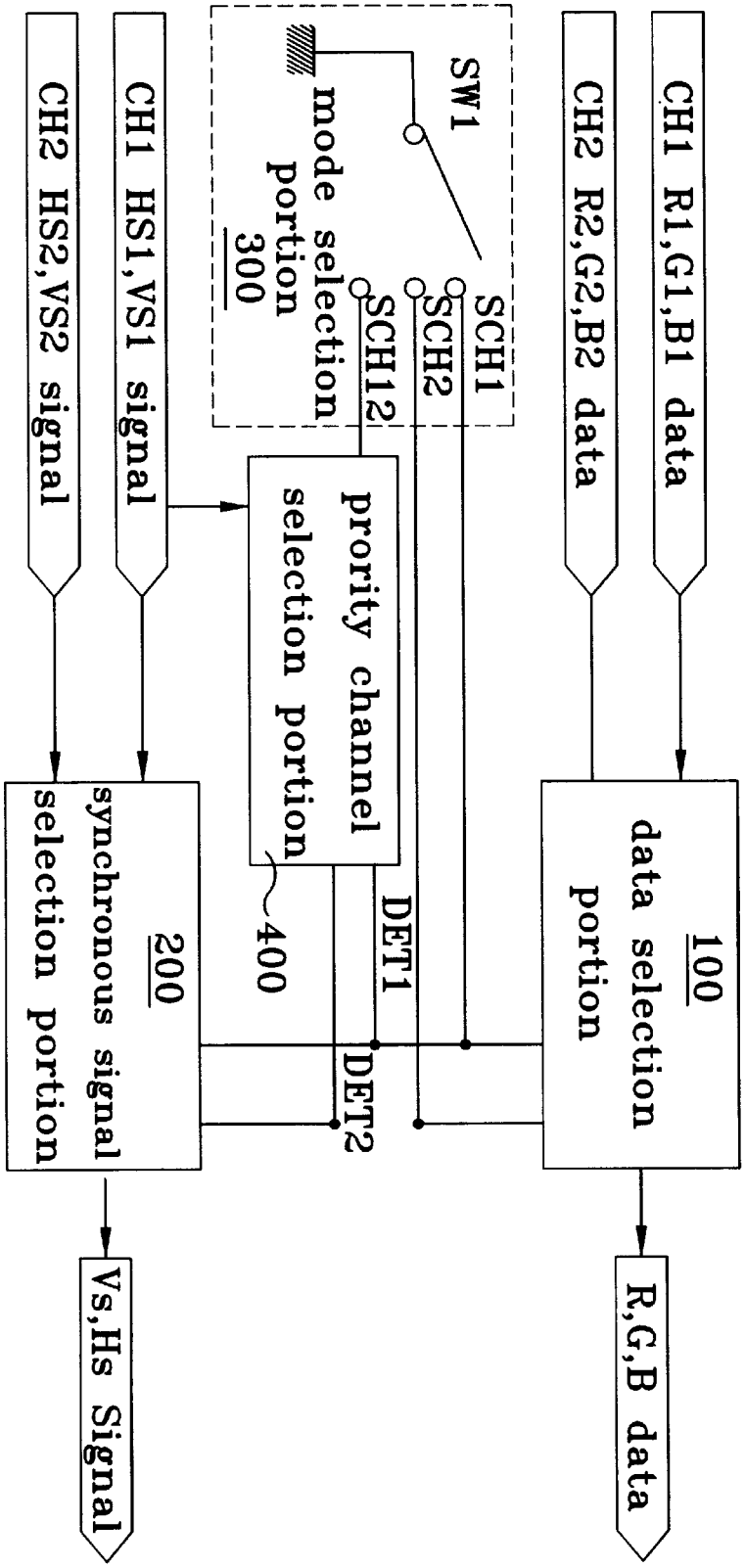
FIG. 1 is a block diagram of an analog video signal selection circuit for LCDs in accordance with an embodiment of the present invention.

FIG. 1 is a block diagram of an analog video signal selection circuit for LCDs in accordance with an embodiment of the present invention. The analog video signal selection circuit comprises a data selection portion 100, a synchronous signal selection portion 200, a mode selection portion and a priority channel selection portion 400. The data selection portion 100 selects one of first data signals R1, G1 and B1 from a first channel CH1 and second data signals R2, G2 and B2 from a second channel CH2 in accordance with channel selection signals SCH1 and SCH2 from the mode selection portion 300 or channel detection signals DET1 and DET2 from the priority channel selection portion 400 and provides the selected data signals as R, G and B data signals.

The synchronous signal selection portion 200 selects one of synchronous signals HS1 and VS1 from a first channel CH1 and synchronous signals HS2 and VS2 from a second channel CH2 in accordance with channel selection signals SCH1 and SCH2 from the mode selection portion 300 and channel detection signals DET1 and DET2 from the priority channel selection portion 400 and provides them as synchronous signals HS and VS.

The mode selection portion 300 generates a first channel selection signal SCH1 and a second channel selection signal SCH2 in a manual mode and generates an auto mode selection signal SCH12 in an auto mode in accordance with an user's selection. The mode selection portion 300 comprises a switch SW1 for generating one of the selection signals, which its common terminal is grounded and its movable terminals are connected to the data selection portion 100, synchronous signal generation portion 200, and the priority channel selection portion 400.

The priority channel selection portion 400 gives a priority to the first channel CH1, which primarily detects whether the horizontal synchronous signal HS1 is received from the first channel CH1 or not, when receiving the auto mode selection signal SCH12 from the mode selection portion 300. The priority channel selection portion 400 generates a first detection signal DET1 for primarily selecting the signals from the first channel, when the horizontal synchronous signal is received from the first channel CH1. In case where the horizontal synchronous signal HS1 is not received from the first channel, the priority channel selection portion 400 generates the second detection signal DET2 for selecting the signals received from the second channel CH2. In the preferred embodiment, the analog video signal selection circuit is set to primarily select the first channel in the auto mode.

The operation of the analog video signal selection circuit having the construction as shown in FIG. 1 will be as follows. Supposed that the first channel CH1 is selected through the switch SW1 of the mode selection portion 300 in the manual mode. The mode selection portion 300 generates a first channel selection signal SCH1 to the data selection portion 100 and the synchronous signal selection portion 200. The data selection portion 100 selects data signals R1, G1 and B1 from the first channel CH1 of data signals received from two channels by the first channel selection signal SCH1 and provides them as R, G and B data signals. At the same time, the synchronous signal selection portion 200 selects the horizontal synchronous signal HS1 and the vertical synchronous signal VS1 from the first channel of synchronous signals received from two channels by the first channel selection signal SCH1 and provides them as synchronous signals VS and HS. Accordingly, a LCD, not shown in drawings, displays the image based on the data signals R1, G1 and B1 and synchronous signals HS1 and VS1 from the first channel CH1.

Next, supposed that the second channel CH2 is selected through the switch SW1 of the mode selection portion 300 in the manual mode. The mode selection portion 300 generates the second channel selection signal SCH2 to the data selection portion 100 and the synchronous signal selection portion 200. The data selection portion 100 selects data signals R2, G2 and B2 received from the second channel CH2 of data signals from two channels by the second channel selection signal SCH2 and provides them as R, G and B data signals. At the same time, the synchronous signal selection portion 200 selects the horizontal synchronous signal HS2 and the vertical synchronous signal VS2 from the second channel CH2 of synchronous signals received from two channels and provides them as synchronous signals VS and HS by the second channel selection signal SCH2. Accordingly, a LCD displays the image based on the data signals R2, G2 and B2 and synchronous signals HS2 and VS2 from the second channel CH2.

On the other hand, supposed that the auto mode is selected through the switch SW1 of the mode selection portion 300. The mode selection portion 300 generates the automode selection signal SCH12 to the priority channel selection portion 400. The priority channel selection portion 400 receives the automode selection signal SCH12 from the mode selection portion 300 and then detects whether the horizontal synchronous signal HS1 from the first channel CH1 is received or not. As result of detection, if the priority channel selection portion 400 detects the horizontal synchronous signal HS1 from the first channel CH1, it generates the detection signal DET1 for primarily selecting the first channel CH1 to the data selection portion 100 and the synchronous signal selection portion 200. In the same manner as the first channel selection in the manual mode, the data selection portion 100 selects the data signals R1, G1 and B1 from the first channel CH1 and the synchronous signal selection portion 200 selects the synchronous signals HS1 and VS1.

On the contrary, the horizontal synchronous signal HS1 from the first channel CH1 is not detected through the priority channel selection portion 400, the priority channel selection portion 400 generates the detection signal DET2 for selecting the second channel CH2 to the data selection portion 100 and the synchronous signal selection portion 200. In the same manner as the second channel selection in the manual mode, the data selection portion 100 selects the data signals R2, G2 and B2 from the second channel CH2 and the synchronous signal selection portion 200 selects the synchronous signals HS2 and VS2 from the second channel.

Figure 2:
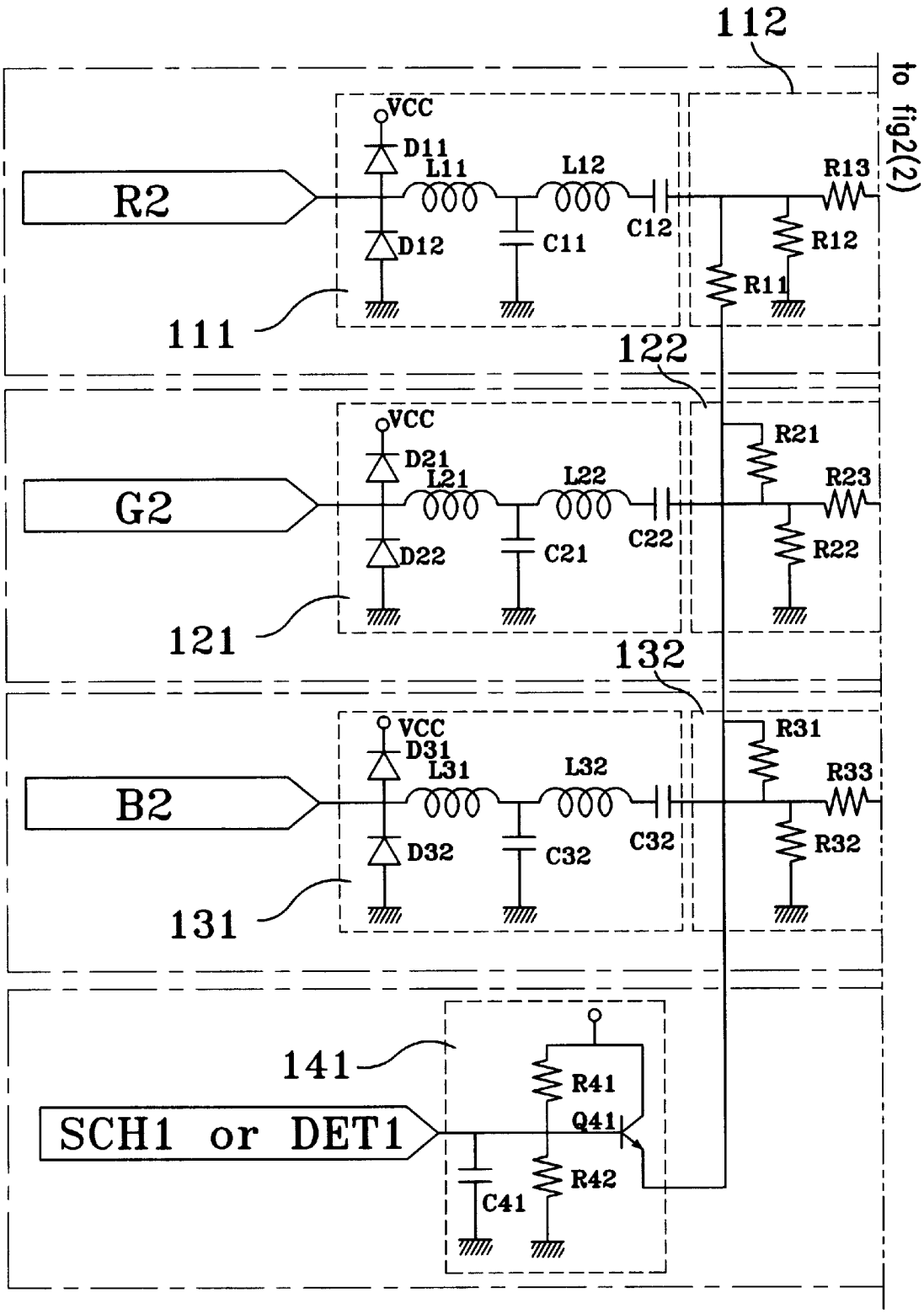
FIG. 2 is a detailed circuit diagram of a data selection portion in the analog video signal selection circuit of FIG. 1.
Figure 2:
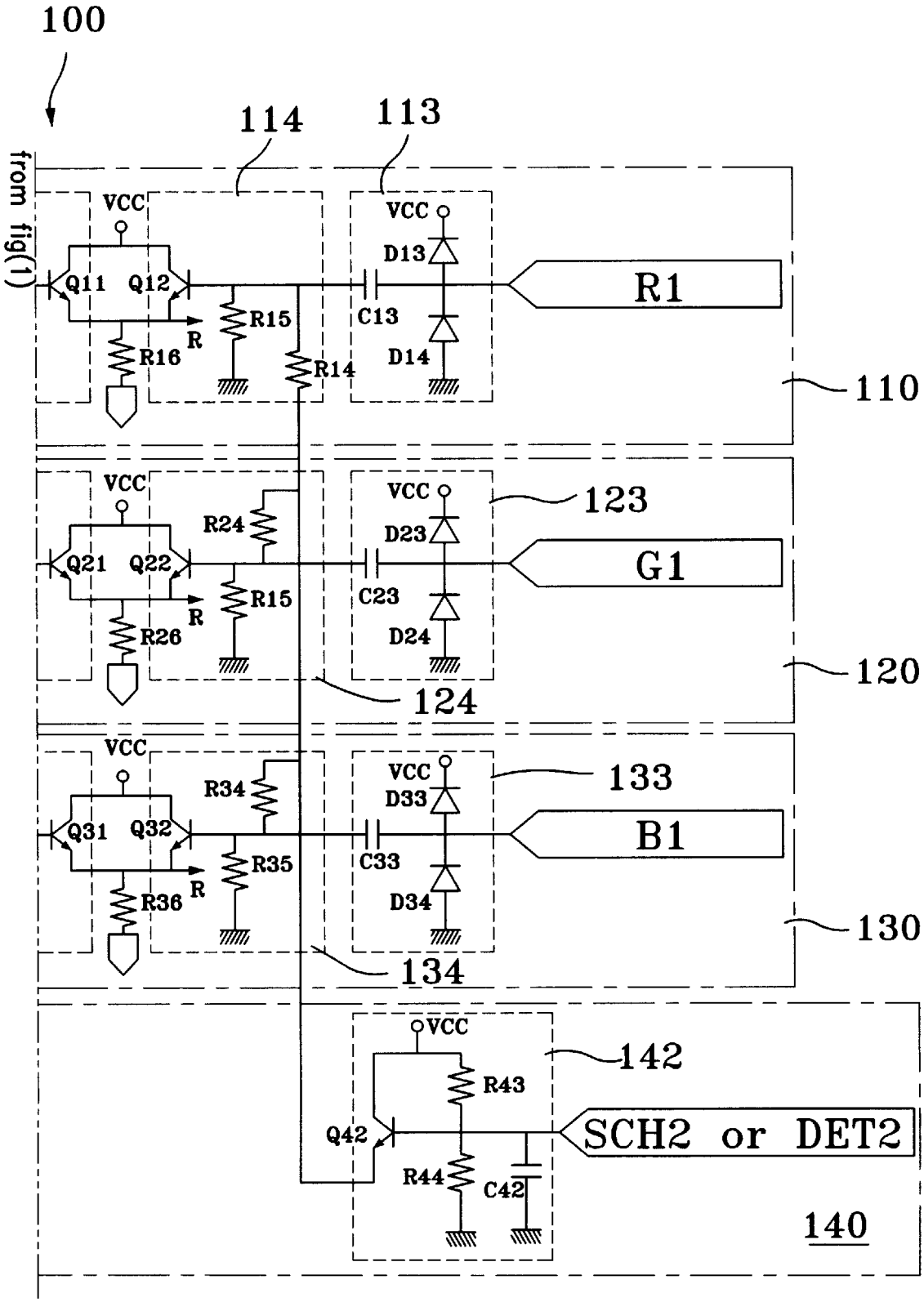

FIG. 2 is a detailed circuit diagram of the data selection portion 100 in the analog video signal selection circuit for LCDs as shown in FIG. 1. The data selection portion 100 comprises a R data selection portion 110 for selecting one of the R1 data signal from the first channel CH1 and the R2 data signal from the second channel CH2, a G data selection portion 120 for selecting one of the G1 data signal from the first channel CH1 and the G2 data signal from the second channel CH2, and a B data selection portion 130 for selecting one of the B1 data signal from the first channel CH1 and the B2 data signal from the second channel CH2.

The data selection portion 110 further comprises an output disable portion 140 for disabling the output of R2, G2 and B2 data signals from the second channel CH2 in accordance with the first channel selection signal SCH1 from the mode selection portion 300 or the first detection signal DET1 from the priority channel selection portion 400 or the output of R1, G1 and B1 data signals from the first channel CH1 in accordance with the second channel selection signal SCH2 from the mode selection portion 300 or the second detection signal DET2 from the priority channel selection portion 400.

The R, G, B data selection portions 110, 120 and 130 each comprises a first input means 111, 121 or 131 for receiving the R2, G2 or B2 data signal from the second channel CH2 and a first output means 112, 122 or 132 for providing the R2, G2 or B2 data signal received through the first input mean 111, 121 or 131 means as the R, G or B data signal. The R, G, B data selection portions 110, 120 130 each comprises a second input means 113, 123 or 133.for receiving the R1, G1 or B1 from the first channel CH1 and a second output means 114, 124 or 134 for providing the R1, G1 or B1 data signal received through the second input means 113, 123 or 133 as the R, G, B data signal.

In the R data selection portion, the first input means 111 comprises diodes D11 and D12, inductors L11 and L12 and condensers C11 and C12. The first output means 112 comprises resistors R11 and R12 and a transistor Q11. The second input means 113 comprises diodes D13 and D14 and a condenser C13 and the second output means 114 comprises resistors R14 and R15 and a transistor Q12. The first and second input means and the first and second output means of the G and B data selection portions 120 and 130 have the same construction as those of the R data selection portion 110.

The output disable portion 140 of the data selection portion 100 comprises a first disable means 141 which simultaneously disables the first output means 112, 122 and 132 of the R, G, B data selection portions 110, 120 and 130 so as to provide the R1, G1 and B1 data signals received from the first channel CH1 as the R, G and B data signals through the second output means 114, 124 and 134 and a second disable means 142 which simultaneously disables the second output means 114, 124 and 134 of the R, G, B data selection portions 110, 120 and 130 so as to provide the R2, G2 and B2 data signals received from the second channel CH2 as the R, G and B data signals through the first output means 112, 122 and 132. Thus, the first disable means 141 disables the first output means 112, 122 and 132 of the R, G and B data selection portions 110–130 to block the output of the R2, G2 and B2 data signals from the second channel CH2 and comprises a condenser C41, resistors R41 and R42 and a transistor Q41. The second disable means 142 disables the second output means 114, 124 and 134 of the R, G and B data selection portions 110–130 to block the output of the R1, G1 and B1 data signals from the first channel CH1 and comprises a condenser C42, resistors R43 and R44 and a transistor Q42.

If the first channel CH1 in the manual mode is selected through the mode selection portion 300, the first channel selection signal SCH1 of a low state from the mode selection portion 300 is provided to the output disable portion 140. The transistor Q41 of the first disable,means is turned off by the first channel selection signal SCR1. According to this, the transistors Q11, Q21 and Q31 of the first output means 112, 122 and 132 are turned off to block the output of the R2, G2 and B2 data signals received from the second channel CH2.

At this time, the second channel selection signal becomes floating and the voltage divided by the resistors R43 and R44 is supplied to the base of the transistor Q42 of the second disable means 142. The transistor Q42 is turned on and the transistors Q12, Q22 and Q32 in the second output means of the R, G, B data selection portions 110–130 are turned on. Accordingly, the R1, G1 and B1 data signals from the first channel CH1 are provided as the R, G, B data signals through the emitters of the transistors Q12, Q22, and Q32, respectively.

If the second channel CH2 in the manual mode is selected, the second channel selection signal SCH2 of the low state is provided to the data selection portion 100. The transistor Q42 in the second disable means 142 of the output disable portion 140 is turned off by the second channel selection signal SCH2. According to this, the transistors Q12, Q22 and Q32 of the second output means 114, 124 and 134 are turned off to block the output of the R1, G1 and B1 data signals received from the first channel CH1.

At this time, the first channel selection signal SCH1 becomes floating and the voltage divided by the resistors R41 and R42 is supplied to the base of the transistor Q41. The transistor is turned on and then the transistors Q11, Q21 and Q31 are turned on. Accordingly, the R2, G2 and B2 data signals received from the second channel CH2 through the first input means 111, 121, and 131 of the R, G, and B data selection portions 110, 120 and 130 are provided as the R, G and B data signals through the emitters of the transistors Q11, Q21 and Q31 of the first output means 112, 122 and 132, respectively.

On the other hand, in the auto mode, if the first detection signal DET1 is provided from the priority channel selection portion 400, the data selection portion 100 provides the R1, G1 and B1 data signals from the first channel CH1 as the R, G and B data signals as the same manner as the first channel selection in the manual mode and if the second detection signal DET2 is provided from the priority channel selection portion 400, the data selection portion 100 provides the R2, G2 and B2 data signals from the second channel CH2 as the R, G and B data signals as the same manner as the second channel selection in the manual mode.

Figure 3:
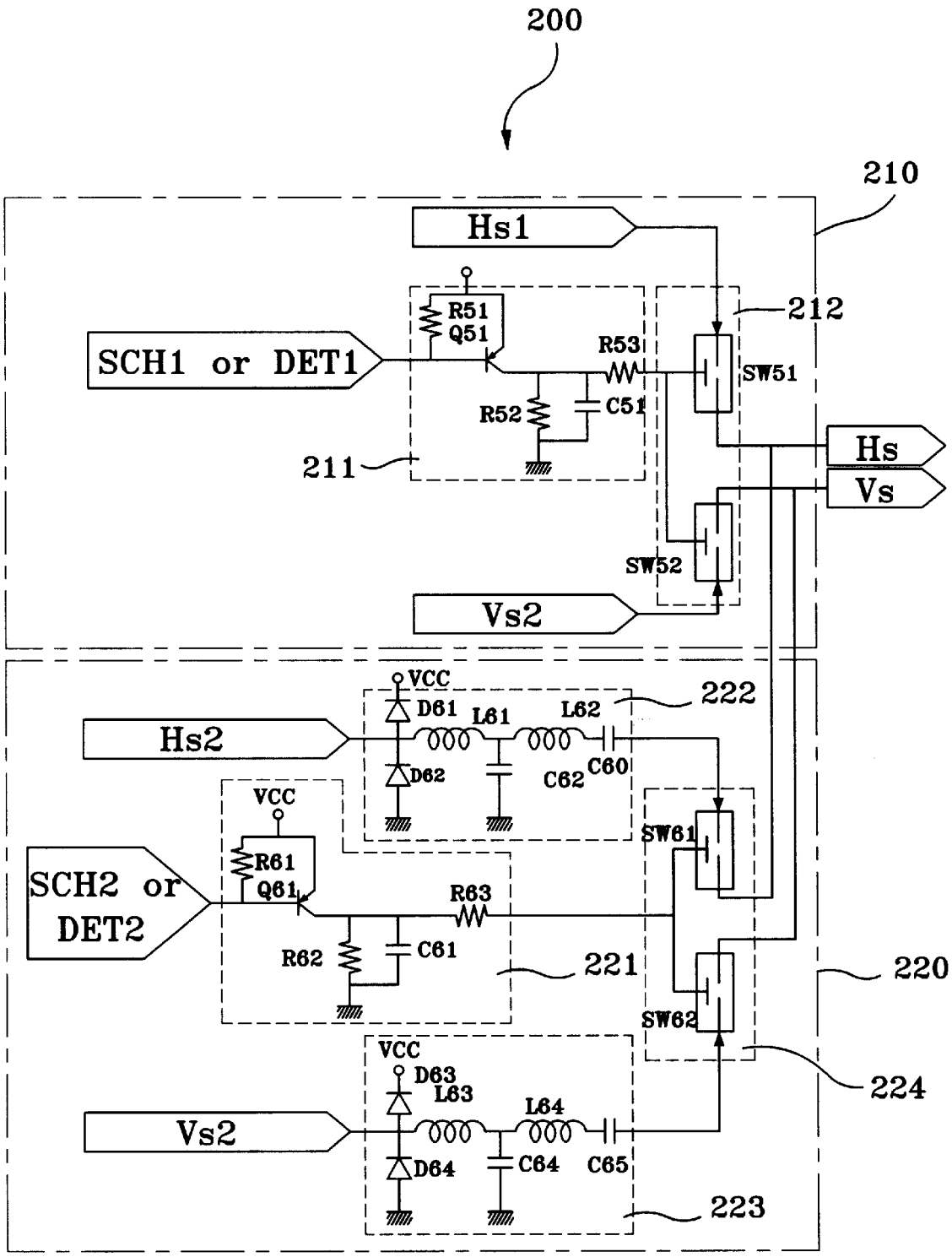
FIG. 3 is a detailed circuit diagram of a synchronous signal selection portion of FIG. 1.

FIG. 3 is a detailed circuit diagram of the synchronous selection portion 200 in the analog video signal selection circuit. The synchronous signal selection portion 200 comprises a first selection portion 210 for selecting the synchronous signals HS1 and VS1 from the first channel CH1 in accordance with the first channel selection signal SCH1 from the mode selection portion 300 and the first detection signal DET1 from the priority channel selection portion 400 and a second selection portion 220 for selecting the synchronous signals HS2 and VS2 from the second channel CH2 in accordance with the second channel selection signal SCH2 from the mode selection portion 300 and the second detection signal DET2 from the priority channel selection portion 400.

The first selection portion 210 comprises a control means 211 which controls an output means 212 according to the first channel selection signal SCH1 or the first detection signal DET1 and includes resistors R51–R53, a condenser C51 and a transistor Q51 and the output means 222 which provides the synchronous signals HS1 and VS1 from the first channel CH1 as the synchronous signals VS and HS under the control of the control means 211 and includes analog switches SW51 and SW52. The second selection portion 220 comprises a control means 221 which controls an output means 224 according to the second channel selection signal SCH2 and the second detection signal DET2 and includes resistors R61–R63, a condenser C61 and a transistor Q61, a first input means 222 which receives the horizontal synchronous signal HS2 from the second channel CH2 and includes diodes D61 and D62, condensers C62 and C63 and inductors L61 and L62, a second input means 223 which receives the vertical synchronous signal HS2 from the second channel CH2 and includes diodes D63 and D63, condensers C64 and C65 and inductors L63 and L64 and the output means 224 which provides the horizontal synchronous signal HS2 received from the first output means 222 and the vertical synchronous signal VS2 received from the second input means 223 as the synchronous signals Hs and Vs under the control of the control means 221 and includes switches SW61 and SW62.

If the first channel selection signal SCH1 from the mode selection portion 300 or the first detection signal DET1 from the priority channel selection portion 400 is supplied to the synchronous signal selection portion 200, the transistor Q51 of the control means 211 in the first selection portion 210 is turned on to drive the analog switches SW51 and SW52 of the output means 212. Accordingly, the horizontal synchronous signal HS1 and the vertical synchronous signal VS1 from the first channel CH1 is provided as the synchronous signals HS and VS through the switches SW51 and SW52, respectively.

On the other hand, if the second channel selection signal SCH2 from the mode selection portion 300 or the second detection signal DET2 from the priority channel selection portion 400 is supplied to the synchronous signal selection portion 200, the transistor Q61 of the control means 221 in the second selection portion 220 is turned on hand to drive the analog switches SW61 and SW62 of the output means 224. Accordingly, the horizontal synchronous signal HS2 received from the first input means 222 and the vertical synchronous signal VS2 received from the second input means 223 are provided as the synchronous signals HS and VS through the analog switches SW61 and SW62.

Figure 4:
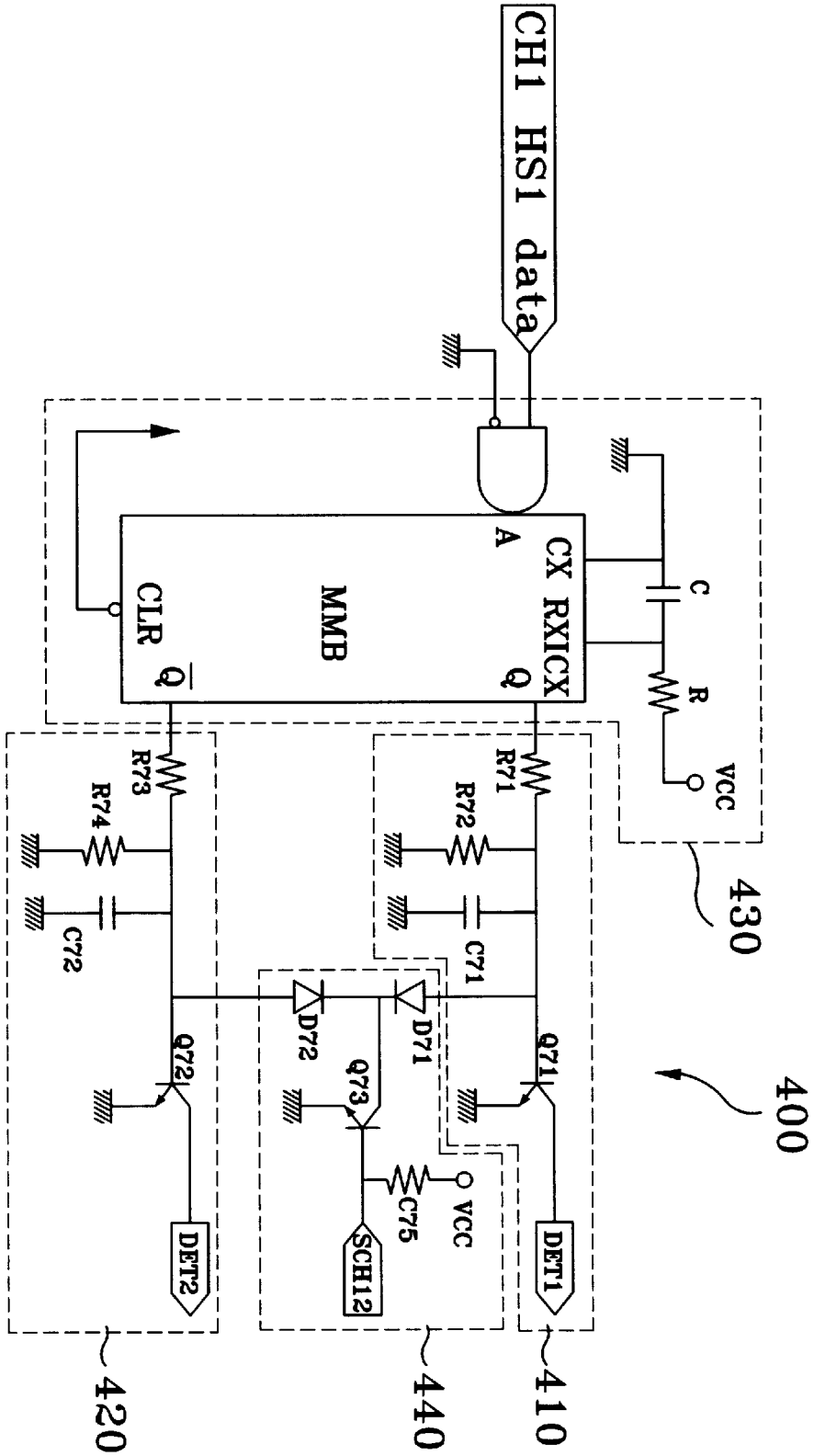
FIG. 4 is a detailed circuit diagram of a priority channel selection portion of FIG. 1.

FIG. 4 is a detailed circuit diagram of the priority channel selection portion 400 in the analog video signal selection circuit. The priority channel selection portion 400 comprises a first signal generation portion 410 which generates the first detection signal DET1 to the data selection portion 100 and the synchronous signal selection portion 200, when the horizontal synchronous signal HS1 is received from the first channel CH1 and includes resistors R71 and R72, a condenser C71 and a transistor Q71, a second signal generation portion 420 which generates the second detection signal DET2 to the data selection portion 100 and the synchronous signal selection portion 200, when the horizontal synchronous signal HS1 is not received from the first channel CH1 and includes resistors R73 and R74, a condenser C72 and a transistor Q72.

The priority channel selection portion 400 comprises a detecting portion 430 which generates a first driving signal for driving the first signal generation portion 410 when the horizontal synchronous signal HS1 from the first channel CH1 is received or otherwise a second driving signal for driving the second signal generation portion 420 and includes a monostable multivibrator MMB and an enable portion 440 which enables the first and second signal generation portions 410 and 420 according to the automode selection signal SCH2 received from the mode selection portion 300 and includes diodes D71 and D72, a resistor R75 and a transistor Q73.

If the automode selection signal SCH2 from the mode selection portion 300 is supplied to the priority channel selection portion 400 in the auto mode, the transistor Q73 of the enable portion 440 is turned off. The transistors Q71 and Q72 of the first and second signal generation portions 410 and 420 is turned on or off by the output signal Q and the inverted output signal/Q of the monostable multivibrator MMB in the detecting portion 430.

When the horizontal synchronous signal HS1 is received from the first channel Cli, the monostable multivibrator MMB outputs the output signal Q of high state and the inverted output signal/Q of low state. The transistor Q71 of the first signal generation portion 410 is turned on to generate the first detection signal DET1 of low state to the data selection portion 100 and the synchronous signal generation portion 200.

When the horizontal synchronous signal HS1 is not received from the first channel CH1, the monostable multivibrator MMB outputs the output signal Q of low state and the inverted output signal/Q of high state. The transistor Q72 of the second signal generation portion 420 is turned on to generate the second detection signal DET2 of low state to the data selection portion 100 and the synchronous signal generation portion 200.

On the other hand, when the automode selection signal SCH2 is not supplied from the mode selection portion 300, the transistor Q73 of the enable means 440 is turned off and the transistors Q71 and Q72 are turned off regardless of the output signals of the monostable multivibrator MMB. Thus, in the manual mode, the first and second generation portions 410 and 420 are disabled.

As above described, the analog video selection circuit for LCDs can manually select one of the video signals received from the different channels and automatically select one by giving the priority to any one of two channels. The analog video signal selection circuit is applicable to a car navigation system using the multi-media.

The foregoing description shows only a preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. An analog video signal selection circuit for a liquid crystal display which selects one of first data of R1, G1 and B1 received from a first channel or second data of R2, G2 and B2 received from a second channel, comprising:

a mode selection means for generating a first channel selection signal and a second channel selection signal in a manual mode and generating an automode selection signal in a auto mode;

a data selection means for selecting one of the first data of R1, G1 and B1 received from the first channel or the second data R2, G2 and B2 received from the second channel and providing the selected data as R, G and B output signals in accordance with the first and second channel selection signals and the automode selection signal generated from the mode selection means; and a synchronous signal selection means for selecting one of a first synchronous data of horizontal and vertical synchronous signals from the first channel and a second synchronous data of horizontal and vertical synchronous signals from the second channel in accordance with the first and second channel selection signals and the automode selection signal generated from the mode selection means.

2. The analog video signal selection circuit as claimed in claim 1, wherein the mode selection means comprises a switch where a common terminal is connected to ground and movable terminals for generating the selection signals are connected the data selection means and the synchronous signal selection means.

3. The analog video signal selection circuit as claimed in claim 1, further comprising a priority channel selection means which detects a signal received from the priority channel of two channel and generates a first signal for selecting a priority channel to the data selection means and the synchronous signal selection means when the signal is received from the priority channel, or a second signal for selecting another channel of two channels to the data selection means and the synchronous signal selection means when the signal is not received from the priority channel, according to the automode selection signal.

4. The analog video signal selection circuit as claimed in claim 3, the priority channel selection means preferentially selects the first channel of two channels.

5. The analog video signal selection circuit as claimed in claim 4, the priority channel selection means generates the priority channel selection signal for selecting the first channel, when the horizontal synchronous signal is received from the first channel.

6. The analog video signal selection circuit as claimed in claim 5, the priority channel selection means includes:

a first signal generation means generates the first detection signal for selecting the priority channel of two channels, when the horizontal synchronous signal is received from the first channel in automode selection;

a second signal generation means generates the second detection signal for selecting another channel of two channels, when the horizontal synchronous signal is not received from the first channel in automode selection;

a detecting means for detecting the horizontal synchronous signal received from the first channel to drive one of the first signal generation means and the second signal generation means; and an enable means for enabling the first and second signal generation means in accordance with the automode selection signal received from the mode selection means.

7. The analog video signal selection circuit as claimed in claim 1, wherein the data selection means includes:

a R data selection means for selecting one of the R1 data from the first channel or the R2 data from the second channel;

a G data selection means for selecting one of the G1 data from the first channel or the G2 data from the second channel;

a B data selection means for selecting one of the B1 data from the first channel or the B2 data from the second channel; and an output disable means for blocking the output of one of the first data of the first channel or the second data of the second channel in accordance with the first and second channel selection signals received from the mode selection means.

8. The analog video signal selection circuit as claimed in claim 7, wherein each of the R, G, B data selection means includes:

a first input means for receiving the first data from the first channel;

a first output means for providing the first data received from the first input means as the R, G, or B output signal;

a second input means for receiving the second data from the second channel; and a second output means for providing the second data from the second input means.

9. The analog video signal selection circuit as claimed in claim 8, wherein the output disable means includes:

a first disable means for simultaneously disabling all the first output means of the R, G and D data selection means in accordance with the first channel selection signal received from the mode selection means; and a second disable means for simultaneously disabling all second output means of the R, G and D data selection means in accordance with the second channel selection signal received from the mode selection means.

10. The analog video signal selection circuit as claimed in claim 1, the synchronous signal selection means includes:

a first selection means for selecting the synchronous signals of the first channel according to the first channel selection signal received from the mode selection means; and a second selection means for selecting the synchronous signals of the second channel according to the second channel selection signal received from the mode selection means.

11. The analog video signal selection circuit as claimed in claim 10, wherein the first selection includes:

an output means for outputting the horizontal synchronous signal and the vertical synchronous signal from the first channel as the output synchronous signals; and a control means for controlling the output means by the first channel selection signal received from the mode selection means.

12. The analog video signal selection means as claimed in claim 10, wherein the second selection includes:

a first input means for receiving the horizontal synchronous signal from the second channel;

a second input means for receiving the vertical synchronous signal from the second channel;

an output means for outputting the horizontal synchronous signal and the vertical synchronous signal of the second channel received from the first and second input means as the output synchronous signals; and a controlling means for controlling the output means by the second channel selection signal received from the mode selection means.

13. An analog video signal selection circuit for a liquid crystal display which selects one of first data of R1, G1 and B1 received from a first channel or second data of R2, G2 and B2 received from a second channel, comprising:

a mode selection means for generating a first channel selection signal and a second channel selection signal in a manual mode and generating an automode selection signal in a auto mode;

a data selection means for selecting one of the first data of R1, G1 and B1 received from the first channel or the second data R2, G2 and B2 received from the second channel and providing the selected data as R, G and B output signals in accordance with the first and second channel selection signals and the automode selection signal generated from the mode selection means;

a synchronous signal selection means for selecting one of a first synchronous data of horizontal and vertical synchronous signals from the first channel and a second synchronous data of horizontal and vertical synchronous signals from the second channel in accordance with the first and second channel selection signals and the automode selection signal generated from the mode selection means; and a priority channel selection means which detects a signal received from the priority channel of two channel and generates a first signal for selecting a priority channel to the data selection means and the synchronous signal selection means when the signal is received from the priority channel, or a second signal for selecting another channel of two channels to the data selection means and the synchronous signal selection means when the signal is not received from the priority channel, according to the automode selection signal.

14. An analog video signal selection circuit for a liquid crystal display which selects one of first data of R1, G1 and B1 received from a first channel or second data of R2, G2 and 32 received from a second channel, comprising:

a mode selection means for generating a first channel selection signal and a second channel selection signal in a manual mode and generating an automode selection signal in a auto mode;

a data selection means for selecting one of the first data of R1, G1 and B1 received from the first channel or the second data R2, G2 and B2 received from the second channel and providing the selected data as R, G and B output signals in accordance with the first and second channel selection signals and the automode selection signal generated from the mode selection means, the data selection means including a R data selection means for selecting one of the R1 data from the first channel or the R2 data from the second channel; a G data selection means for selecting one of the G1 data from the first channel or the G2 data from the second channel; a B data selection means for selecting one of the B1 data from the first channel or the B2 data from the second channel; and an output disable means for blocking the output of one of the first data of the first channel or the second data of the second channel in accordance with the first and second channel selection signals received from the mode selection means; and a synchronous signal selection means for selecting one of a first synchronous data of horizontal and vertical synchronous signals from the first channel and a second synchronous data of horizontal and vertical synchronous signals from the second channel in accordance with the first and second channel selection signals and the automode selection signal generated from the mode selection means, the synchronous signal selection means including a first selection means for selecting the synchronous signals of the first channel according to the first channel selection signal received from the mode selection means; and a second selection means for selecting the synchronous signals of the second channel according to the second channel selection signal received from the mode selection means.

15. An analog video signal selection circuit for a liquid crystal display which selects one of first data of R1, G1 and B1 received from a first channel or second data of R2, G2 and B2 received from a second channel, comprising:

a mode selection means for generating a first channel selection signal and a second channel selection signal in a manual mode and generating an automode selection signal in a auto mode;

a data selection means for selecting one of the first data of R1, G1 and B1 received from the first channel or the second data R2, G2 and B2 received from the second channel and providing the selected data as R, G and B output signals in accordance with the first and second channel selection signals and the automode selection signal generated from the mode selection means, the data selection means including a R data selection means for selecting one of the R1 data from the first channel or the R2 data from the second channel; a G data selection means for selecting one of the G1 data from the first channel or the G2 data from the second channel; a B data selection means for selecting one of the B1 data from the first channel or the B2 data from the second channel; and an output disable means for blocking the output of one of the first data of the first channel or the second data of the second channel in accordance with the first and second channel selection signals received from the mode selection means;

a synchronous signal selection means for selecting one of a first synchronous data of horizontal and vertical synchronous signals from the first channel and a second synchronous data of horizontal and vertical synchronous signals from the second channel in accordance with the first and second channel selection signals and the automode selection signal generated from the mode selection means, the synchronous signal selection means including a first selection means for selecting the synchronous signals of the first channel according to the first channel selection signal received from the mode selection means; and a second selection means for selecting the synchronous signals of the second channel according to the second channel selection signal received from the mode selection means; and a priority channel selection means which detects a signal received from the priority channel of two channel and generates a first signal for selecting a priority channel to the data selection means and the synchronous signal selection means when the signal is received from the priority channel, or a second signal for selecting another channel of two channels to the data selection means and the synchronous signal selection means when the signal is not received from the priority channel, according to the automode selection signal, the priority channel selection means including a first signal generation means generates the first detection signal for selecting the priority channel of two channels, when the horizontal synchronous signal is received from the first channel in automode selection; a second signal generation means generates the second detection signal for selecting another channel of two channels, when the horizontal synchronous signal is not received from the first channel in automode selection; a detecting means for detecting the horizontal synchronous signal received from the first channel to drive one of the first signal generation means and the second signal generation means; and an enable means for enabling the first and second signal generation means in accordance with the automode selection signal received from the mode selection means.

* * * * *